US005624329A

United States Patent [19]

Schneebeli

[11] Patent Number: 5,624,329

[45] Date of Patent: Apr. 29, 1997

[54] MATCHED PUTTER/CHIPPER GOLF CLUBS

[76] Inventor: Robert E. Schneebeli, P.O. Box 1268, Renton, Wash. 98057

[21] Appl. No.: 642,429

[22] Filed: May 3, 1996

[51] Int. Cl.[6] ..... A63B 53/00; A63B 53/04; A63B 53/14

[52] U.S. Cl. ..... 473/287; 473/300; 473/325; 473/340; 473/313; 473/314

[58] Field of Search ..... 473/324, 325, 473/287, 300, 305, 313, 314, 316, 292, 293, 251, 304, 340

[56] References Cited

U.S. PATENT DOCUMENTS

| | | |
|---|---|---|
| 1,257,471 | 2/1918 | Fitzjohn et al. . |
| 1,599,336 | 9/1926 | Lindgren . |
| 2,661,952 | 12/1953 | Jackson . |
| 2,820,638 | 1/1958 | Morrison . |
| 2,877,018 | 3/1959 | Turner . |
| 2,962,286 | 11/1960 | Brouwer . |
| 3,204,962 | 9/1965 | McCormick . |
| 3,392,977 | 7/1968 | De Lacey . |
| 3,416,798 | 12/1968 | Penningtom . |
| 3,574,349 | 4/1971 | Kropp . |
| 3,625,517 | 12/1971 | Purnack . |
| 3,984,103 | 10/1976 | Nix . |
| 4,629,191 | 12/1986 | Mancusco . |
| 4,778,180 | 10/1988 | Guenther . |
| 4,795,158 | 1/1989 | Kuykendall . |
| 5,458,335 | 10/1995 | Hattori ..... 473/325 |

OTHER PUBLICATIONS

Ralph Maltby Enterprises, Inc. Newark, Ohio, 1993 Full Line Catalog entitled "The Golfworks", particularly at pp. 1–33 (the ACS18 putter and ACS19 chipper) and at pp. 2–1 (the KACS18 putter and the KACS19 chipper).

*Primary Examiner*—Sebastiano Passaniti
*Attorney, Agent, or Firm*—Graybeal Jackson Haley LLP

[57] ABSTRACT

A matched pair of golf clubs, designed for putting and chipping usage, which have identical heads with identical shafts and grips except that one head has a striking face with the loft of a putter and the other head has a striking face with the loft of a chipper, the said clubs being otherwise identical in weight, length, balance and feel. Preferably each head has a striking face with the loft of a putter and a reverse striking face with the loft of a chipper, with one club being a right handed putter and a left handed chipper and the other club being right handed chipper and a left handed putter. Chipping and putting with these clubs, using the clubs in sequence and in the manner of a putter, tends to improve the golfer's confidence and the chances of finishing a hole with fewer strokes than might otherwise be the case.

7 Claims, 2 Drawing Sheets

MATCHED PUTTER/CHIPPER GOLF CLUBS

BACKGROUND OF THE INVENTION

1. Field of the Invention

The present invention relates to golf clubs designed for chipping and putting and more particularly in preferred form to a pair of reversely identical golf clubs each usable as a putter on one striking face and as a chipper on an opposite striking face and with such striking faces respectively reversely arranged.

2. Description of the Prior Art

Golf clubs in matched sets with all the clubs in a class (irons and/or woods) having equal shaft length, equal lie angle, equal swing weight, and equal total weight are known as in Nix U.S. Pat. No. 3,984,103, the concept involved in such sets being that these equal parameters apply to all clubs of a given class, i.e. irons 1 through 9 and/or woods 1 through 4. This concept, as disclosed in said U.S. Pat. No. 3,984,103, does not contemplate any application of the concept to putters or chippers, as such, although it is of course known for a golfer to often use a more or less high numbered iron for chipping purposes.

Also know is a type of golf club such as disclosed in Fitzjohn et al. U.S. Pat. No. 1,257,472 which combines in one club a lofting and driving face and also an opposite face which is only slightly inclined from a perpendicular plane relative to the bottom of the club head. In this patent, the usage of the only slightly inclined opposite face is said to be for left-hand driving.

Pennington U.S. Pat. No. 3,416,798 discloses a golf club with two hitting faces on opposite sides. Selection of one or the other of the hitting faces is by rotation of the club shaft about its axis 180°.

Known as well are various prior golf clubs having adjustable heads for providing a ball striking face at various angles such as disclosed in Brouwer U.S. Pat. No. 2,962,286, McCormick U.S. Pat. No. 3,204,962, De Lacey U.S. Pat. No. 3,392,977 and Guenther U.S. Pat. No. 4,778,180. However, adjustable head golf clubs are not germaine to the present invention and characteristically are not reliable over extended periods of use because of impact induced wear and misalignment of movable parts.

SUMMARY OF THE INVENTION

A primary advantage and feature of the present invention is to provide a matched pair of golf clubs specifically addressing a common problem for many golfers, that of being able to chip a golf ball which is in the rough, fairway, or fringe of the green and several feet or several yards off the putting green accurately to a position on the green and reasonably close to the hole. A conventional putter is not suitable for the purpose because of the longer grass or irregular ground between the ball and the green and therefore an iron with a desired loft (ranging from perhaps a five iron to a sand wedge as a matter of personal choice) is commonly used to chip the ball onto the green. In such use of a lofting iron for chipping purposes, however, the club length, weight and feel of the iron used for chipping is quite different than the length, weight, grip and feel of a putter so that the golfer must make a substantial adjustment in approach and manner of use of each club when progressing from use of one club to the next, often with less than optimal results from the point of view of getting the ball as close to the hole as needed to finish the hole with but one putt on the green. Alignment with the hole when using a conventional iron for chipping is also more difficult than alignment of a putter with the hole.

The golf clubs of the present invention tend to resolve the difficulties commonly encountered by most golfers in getting a ball close to the hole from slightly off the green by providing for use by the golfer of a matched pair of clubs, one of which has a chipper style striking face on its leading face, considered from the point of view of the direction or line of flight or travel of the ball when struck, and the other of which as a putter style striking face on its leading face. To provide the clubs with equal feel and performance characteristics so that the golfer needs essentially no adjustment of swing or stance when shifting or progressing from use of one club to use of the other, the clubs are provided with identical parameters in terms of identical shafts, identical grips, and otherwise identical heads of like dimensions and weight. To provide the respective club heads with like dimensions and weight as well as to simplify the manufacture of and improve the utility for oppositely handed use, it is a preferred feature of the club heads according to the present invention that the matched pair of clubs involve one club configured with one striking face for use as a putter by a golfer playing right handed and another striking face for use as a chipper by a golfer playing left handed, with the other club having a striking face usable as a chipper by a golfer playing right handed and another striking face usable as a putter by a golfer playing left handed.

The close similarity of the two clubs, used one after the other and both used in a manner similar to the customary way in which a putter is used, encourages a golfer to use a putting stroke when using the chipper, thereby increasing confidence in and improving the probability that the chip shot will be close to the cup. The golfer in effect can use the chipper like he normally uses a putter, i.e. "think putter" while chipping, because the chipper has the size, weight and feel of the associated putter.

Usage involving a sequence of chipping and putting with these clubs, using the clubs in sequence, tends to promote a feeling of confidence in the clubs and to improve the chances of a golfer finishing a hole with fewer strokes than might otherwise be the case.

Other features of the matched pair of clubs of the invention include the provision for attachment of the club shaft to the blade at an identical lie angle on each club, considering the angle of attachment in a plane at right angles to the direction of travel of the ball. Also, the clubs are characterized by identical points of connection of the shafts to the club heads, in the toe-to-heel dimension of the heads. Another feature is that the pair of golf clubs according to the present invention include grips which are identical and which may be of a style normally used for conventional putters, with a non-circular cross-section. Yet another feature of these golf clubs is that each club is identically dimensioned so that an extension of the centerline of the shaft is equispaced from the points of impact of a ball on the striking faces of the head, as measured in the horizontal direction of the intended line of travel of the ball when struck.

These and other objects, feature and advantages will occur to those skilled in the art to which the invention is addressed, in the light of the following description and accompanying illustrations of a preferred embodiment thereof.

DESCRIPTION OF THE PREFERRED EMBODIMENT

Figure 1:
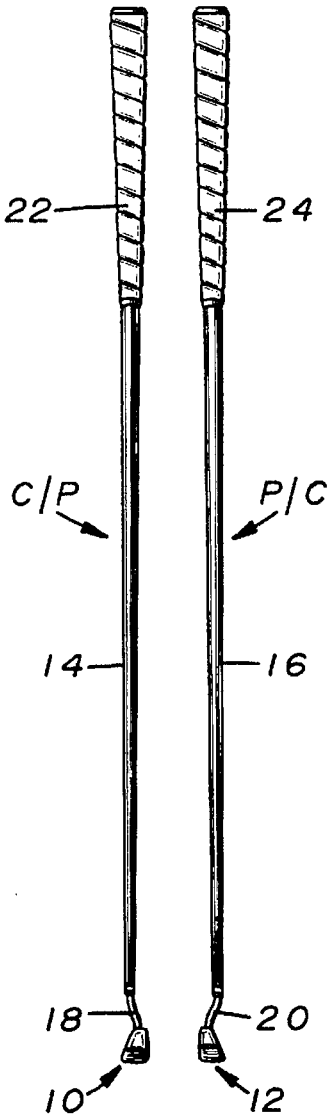
FIG. 1 is a front view in a horizontal direction of a matched pair of golf clubs which are a preferred embodiment of the invention.
Figure 2:
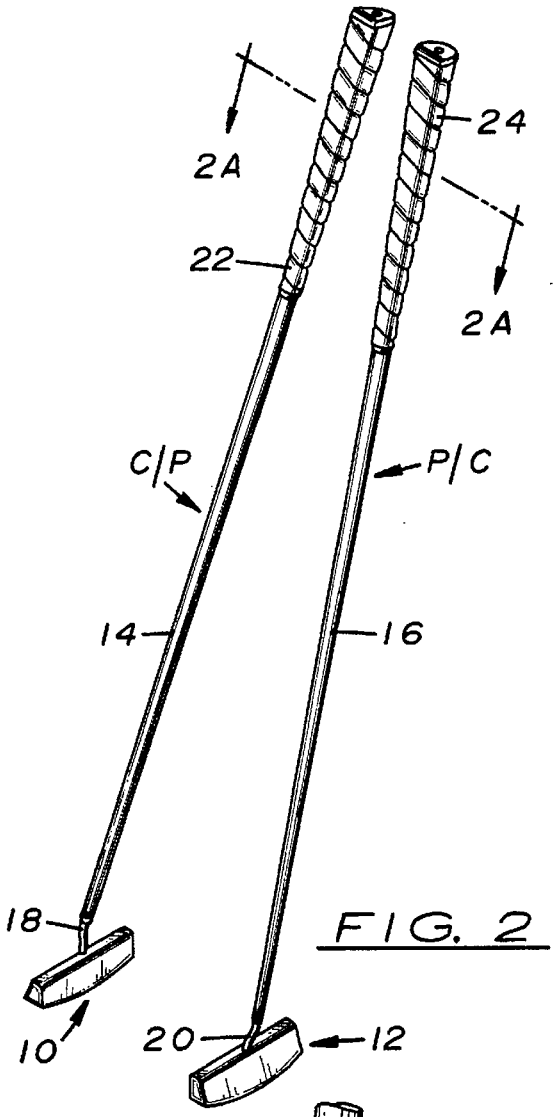
FIG. 2 is an isometric view of the clubs shown in FIG. 1.

FIGS. 1 and 2 illustrate in respective front view and isometric view a matched pair of chipper/putter golf clubs C/P and P/C according to the present invention, each comprising a respective head or blade 10, 12, shaft 14, 16, hosel 18, 20 and grip 22, 24.

Figure 3:
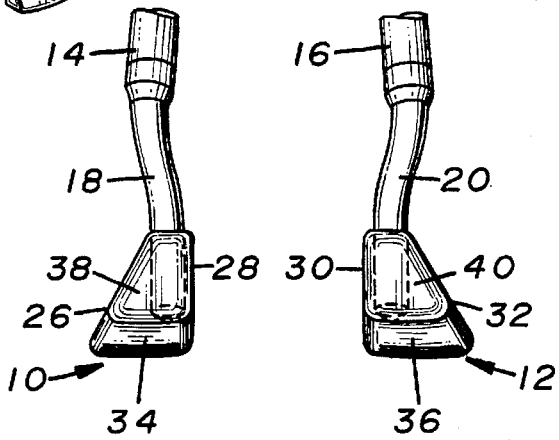
FIG. 3 is a front or toe detail view of the heads, hosels and portions of the lower ends of the shafts of the golf clubs shown in FIGS. 1 and 2.
Figure 6:
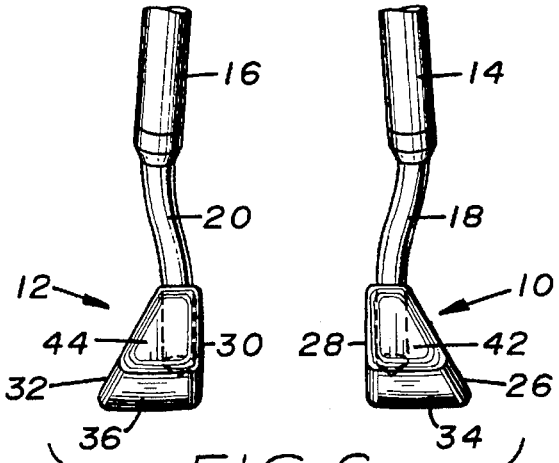
FIG. 6 is a rear or heel view of the club heads and related club portions shown in FIG. 3.
Figure 7:
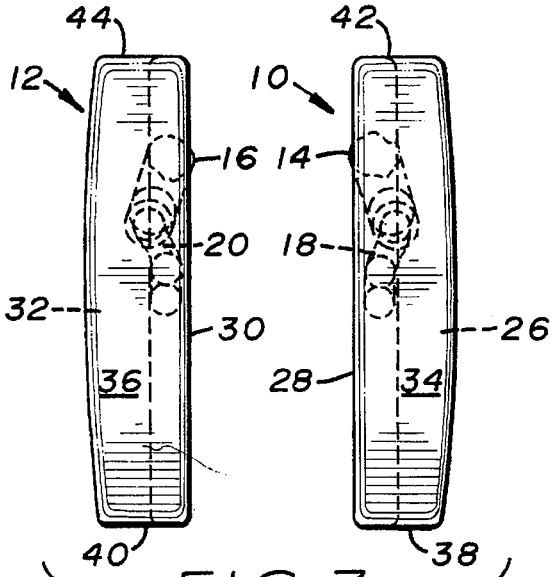
FIG. 7 is a bottom view of the club heads and related club portions shown in FIG. 3.

Club head 10 of golf club C/P comprises a striking face 26 with the loft of a chipper and a reverse striking face 28 with the loft of a putter. Reversely, club head 12 of club P/C comprises a striking face 30 with the loft of a putter and an opposite striking face 32 with the loft of a chipper. The club heads 10, 12 additionally comprise respective soles 34, 36 and respective toes 38, 40 and heels 42, 44 (FIGS. 3 and 6). The soles 34, 36 are of rounded form both in their head-to-toe dimension and in the dimension laterally thereof, to reduce the chance of the toe, heel or leading edge of the club head being caught by grass, which can be a problem particularly when using a club as a chipper.

Figure 4:
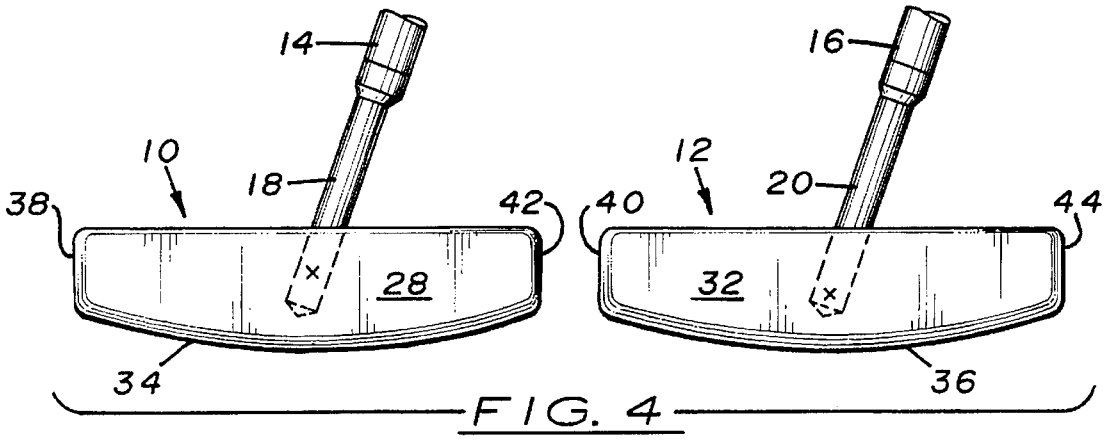
FIG. 4 is a left side view of the golf club heads and related club portions shown in FIG. 3.
Figure 5:
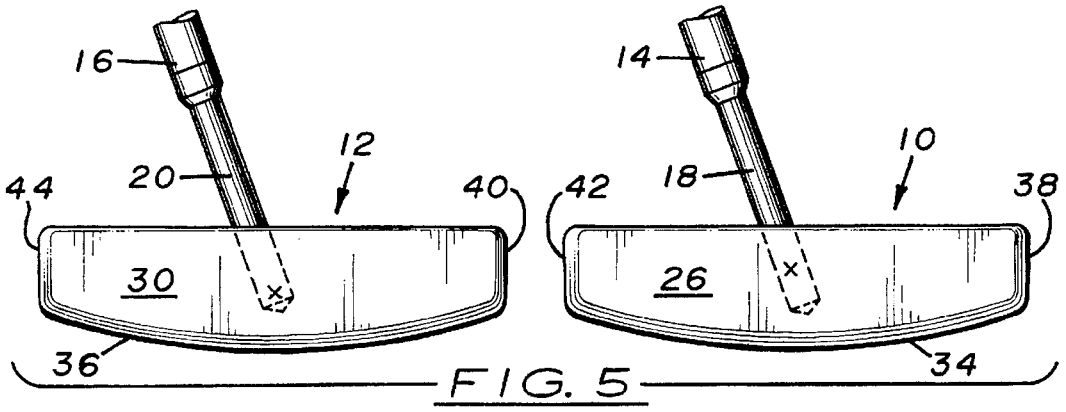
FIG. 5 is a right side view of the golf club heads and related club portions shown in FIG. 3.

As evident in FIGS. 3–7, the geometry of the hosels 18, 20 bring the extended centerline of the respective shafts 14, 16 to points about the same distance behind the strike point x of the putter striking face as that for the strike point x of the chipper striking face in each club (FIGS. 4 and 5). Also, in each instance the centerline of the shaft is aligned with the center of gravity of the head toe-to-heel so the club is face-balanced, eliminating any torque during the stroke. The respective heads 10, 12 hosels 18, 20, and shafts 14, 16 with grips 22, 24 are all of respectively of like size, weight and configuration to provide like feel and performance characteristics.

As will be apparent, the golf clubs as illustrated and discussed are relatively simple to fabricate from but one or at most two dies and with minimal tooling. Respective hosels 18, 20 are separately fabricated then bonded to respective heads 10, 12 and shafts 14, 16, such as by use of epoxy.

Figure 2A:
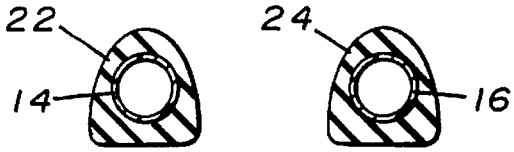
FIG. 2A is a detailed cross-sectional view through the grips of the clubs shown in FIGS. 1 and 2, taken substantially along line 2A—2A of FIG. 2.

By way of specific example, the club heads 10, 12 are suitably bronze castings, finished on all surfaces with glass bead peening and chemically dipped for patina with the striking face hand sanded. The hosels are suitably turned from bronze bar stock and offset or joggled. The loft of the putter striking face is suitably 3° and of the chipper striking face is suitably 32°, with the lie of the shaft being suitably 70° from horizontal. Typical head weight is 315 grams plus or minus 2 grams. The putter shafts 14, 16 in the embodiment presented, are constant taper steel putter shafts and the grips 22, 24 are Lambkin Perma-Tac putter grips. FIG. 2A shows these grips in cross-section, with the non-circular forwardly flat configuration commonly used for putter grips. As indicated, these putter style grips provide that the clubs, when used as chippers have more of the feel of a putter.

As will be understood, additional features, conventional per se, may be incorporated in clubs according to the invention, such as grooves, punch marks or other markings, and proprietary designations on the club heads.

From the foregoing, various further advantages, features, modifications and adaptations of the golf clubs and components thereof characteristic of the present invention will occur to those skilled in the art to which the invention is addressed, within the scope of the following claims.

What is claimed is:

1. A matched pair of golf clubs designed for putting and chipping usage, said golf clubs having reversely identical heads with identical shafts with each head having a striking face with the loft of a putter and a reverse striking face with the loft of a chipper, with the angle of the lie of the centerline of each shaft being at an angle of about 70 relative to the heel-to-toe centerline of the associated club head, and with one said club being a right handed putter or a left handed chipper and the other said club being a right handed chipper or a left handed putter, said clubs being otherwise identical in weight, length, balance and feel.

2. A matched pair of golf clubs according to claim 1, wherein the grip on each club shaft is of non-circular cross-section with a forwardly facing flattened surface and a rearwardly facing rounded surface.

3. A matched pair of golf clubs according to claim 1, wherein each club shaft is joined to each club head by a hosel and each said club head and associated hosel is separately fabricated then bonded together.

4. A matched pair of golf clubs according to claim 1, wherein each club comprises a hosel interconnecting the club shaft and club head, with the configuration of said hosel being such that the centerline of the shaft is directed to a point about the same distance behind the striking point of the striking face with the loft of a putter as the distance such centerline is behind the striking point of the striking face with the loft of a chipper.

5. A matched pair of golf clubs according to claim 1, wherein each said club is configured so that the centerline of the shaft is directed through the center of gravity of the head, considered toe-to-heel, so the club is face-balanced, eliminating any torque during a striking action.

6. A matched pair of golf clubs according to claim 1, wherein each club head comprises a sole which is of rounded configuration toe-to-heel.

7. A matched pair of golf clubs according to claim 1, wherein the loft of each putter striking face is about 3 and the loft of each chipper striking face is about 32.

* * * * *

UNITED STATES PATENT AND TRADEMARK OFFICE

CERTIFICATE OF CORRECTION

PATENT NO. : 5,624,329

DATED : April 29, 1997

INVENTOR(S) : Robert E. Schneebeli

It is certified that error appears in the above-indentified patent and that said Letters Patent is hereby corrected as shown below:

Claim 1, line 6, change "70" to "70°".

Claim 7, line 2, change "3" to "3°".

Claim 7, line 3, change "32" to "32°".

Signed and Sealed this

Fourteenth Day of October, 1997

*Attest:*

Bruce Lehman

BRUCE LEHMAN

*Attesting Officer*

*Commissioner of Patents and Trademarks*